US007814607B1

(12) United States Patent
Wilson, Sr.

(10) Patent No.: US 7,814,607 B1
(45) Date of Patent: Oct. 19, 2010

(54) CONCRETE EDGER AND KEYWAY DEVICE

(76) Inventor: Richard M. Wilson, Sr., 7089 359th St., Hartley, IA (US) 51346

( * ) Notice: Subject to any disclaimer, the term of this patent is extended or adjusted under 35 U.S.C. 154(b) by 691 days.

(21) Appl. No.: 11/834,205

(22) Filed: Aug. 6, 2007

(51) Int. Cl.
*B05C 17/10* (2006.01)

(52) U.S. Cl. ..... 15/235.8; 15/235.4; 15/235.6

(58) Field of Classification Search ..... 15/235.8, 15/235.4, 235.5, 235.6, 235.7
See application file for complete search history.

(56) References Cited

U.S. PATENT DOCUMENTS 761,242 A * 5/1904 Meyers ..... 15/235.7
4,155,141 A * 5/1979 Guerra ..... 15/235.8
5,160,748 A * 11/1992 Gauuan ..... 425/458

* cited by examiner

*Primary Examiner*—Shay L Karls
(74) *Attorney, Agent, or Firm*—Lawrence J. Gibney, Jr.

(57) ABSTRACT

During the construction of a building it is necessary to smooth the concrete, create a keyway for the wall and produce a slight curve on the edge of the concrete slab. The current device will enable the operator to perform all three tasks with one tool. The position of the keyway may be adjusted depending on the specific requirements of the construction project.

4 Claims, 3 Drawing Sheets

CONCRETE EDGER AND KEYWAY DEVICE

BACKGROUND OF THE INVENTION

A. Field of the Invention

This relates to the construction of large concrete structures and specifically enabling a worker to place a curve on the outside edge of the concrete slab such as a sidewalk while also producing a keyway for the wall at the same time.

B. Prior Art

There are many other prior art references to keyway making devices. A representative example of this type of device is found at Gauuan, U.S. Pat. No. 5,160,748. This reference makes a keyway in the center of the device and smoothes the concrete on the respective sides of the keyway. It does not produce a curved edge on the concrete slab.

The device in this case produces a keyway in the slab while at the same time produces a curved edge on the edge of the slab.

BRIEF SUMMARY OF THE INVENTION

In a construction project, particularly in erecting large concrete walls, it is necessary to produce a keyway. The keyway is an indentation in the concrete slab and is used to anchor a wall; the keyway is the groove in the concrete foundation into which the wall is placed. The keyway is typically six inches in depth although keyway depth can vary from building to building.

Currently, in order to make a keyway, a line is drawn from one end of a concrete slab to the other, and a small piece of wood is physically pushed by a worker through the concrete to produce the keyway. A separate worker produces a curve on the edge of the concrete slab by using a separate tool.

The current device is a portable handheld apparatus that has a keyway-making device at one end as well as a curved structure at the other end to produce the desired curve on the slab. This tool accomplishes the goal of producing a keyway and a curve on the edge of a concrete slab at the same time.

Before the device is placed on the concrete slab structure, the worker must first determine the center of the keyway. Once this measurement is determined, the length of the adjusting arms using the means to adjust determined the position of the keyway. As the device is used the keyway is pushed through the concrete foundation as the concrete is being poured but prior to the concrete completely drying. At the same time the device will also produce a curve on the curb or outside edge of the concrete slab as the keyway is produced. In this manner, the tool satisfies both objectives and results in tremendous labor savings.

DETAILED DESCRIPTION OF THE EMBODIMENTS

Figure 1:
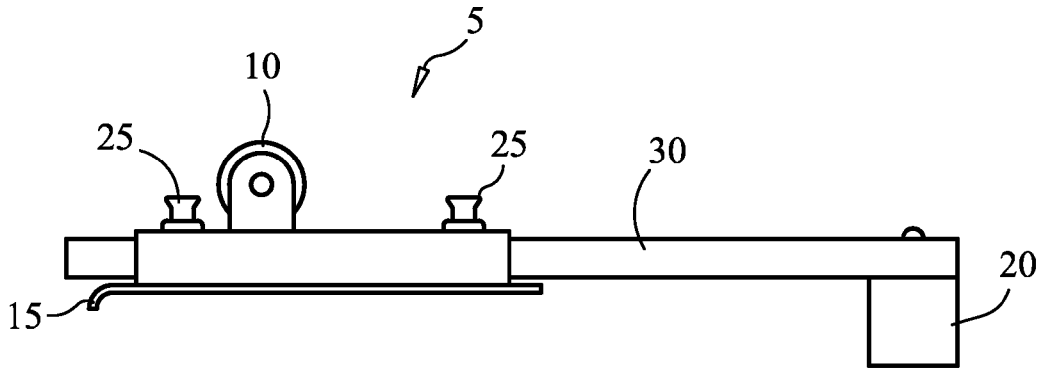
FIG. 1 is a front view of the device.
Figure 2:
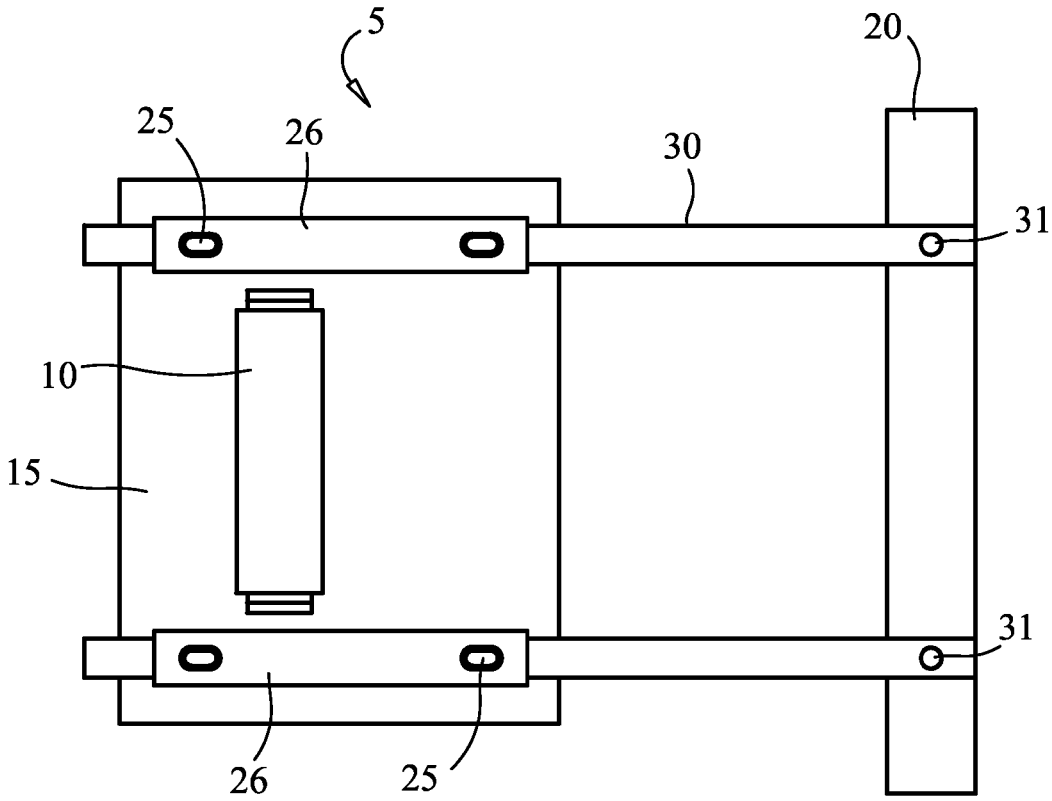
FIG. 2 is a top view of the device.

This is a concrete edger and keyway tool 5, which is portable, handheld and can be moved easily from site to site.

A handle 10 will be provided in order to operate this device. A flat surface 15 will be connected to the handle and will be used in the operation of this device and act as a trowel. The flat surface 15 is used to smooth the concrete as it is moved across the concrete. On the top of the flat surface 15 will be a series of tubes 26 into which the horizontal members 30 will be placed.

On one end of the device will be a keyway maker 20. This keyway maker is a cubic structure as depicted in FIG. 1 and extends vertically from a set of horizontal members 30 a predetermined distance. The length of the keyway maker 20 is determined by the keyway that needs to be formed in the concrete. Although the keyway maker 20 is depicted as a cube in FIG. 1, the keyway maker may have several different shapes depending on the particular needs of the job.

The keyway maker 20 is secured to the horizontal members 30 with a connection means 31 probably by using a screw or other type fastener. Depending on the specific keyway that is to be made, the keyway maker 20 can be changed to produce a tapered keyway as opposed to a simply rectangular or cubic keyway as depicted in FIG. 1.

Figure 3:
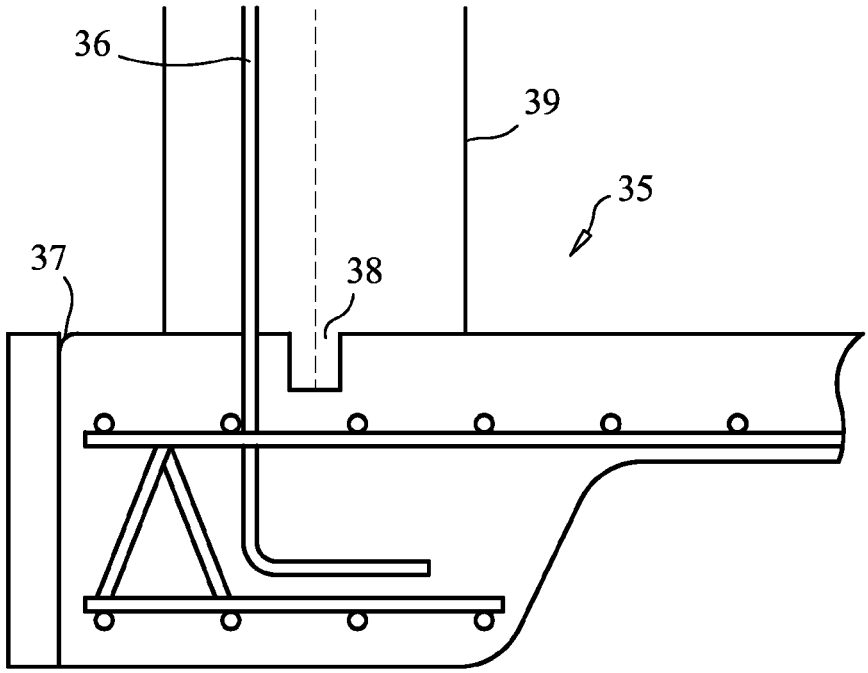
FIG. 3 is a representative view of a wall in the ground and a wall structure.
Figure 4:
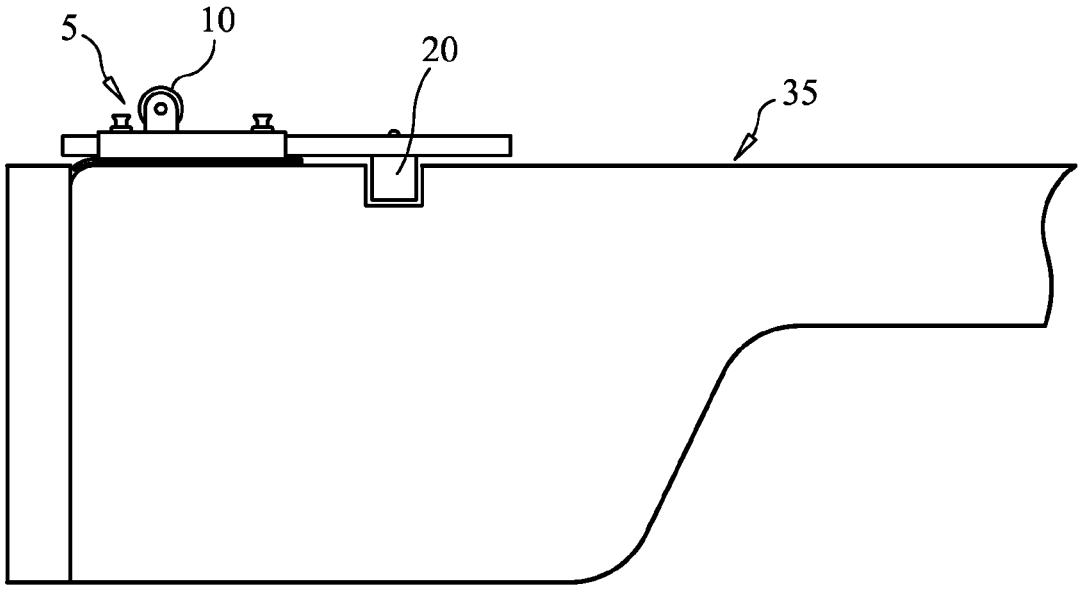
FIG. 4 is a view of the device in use.
Figure 5:
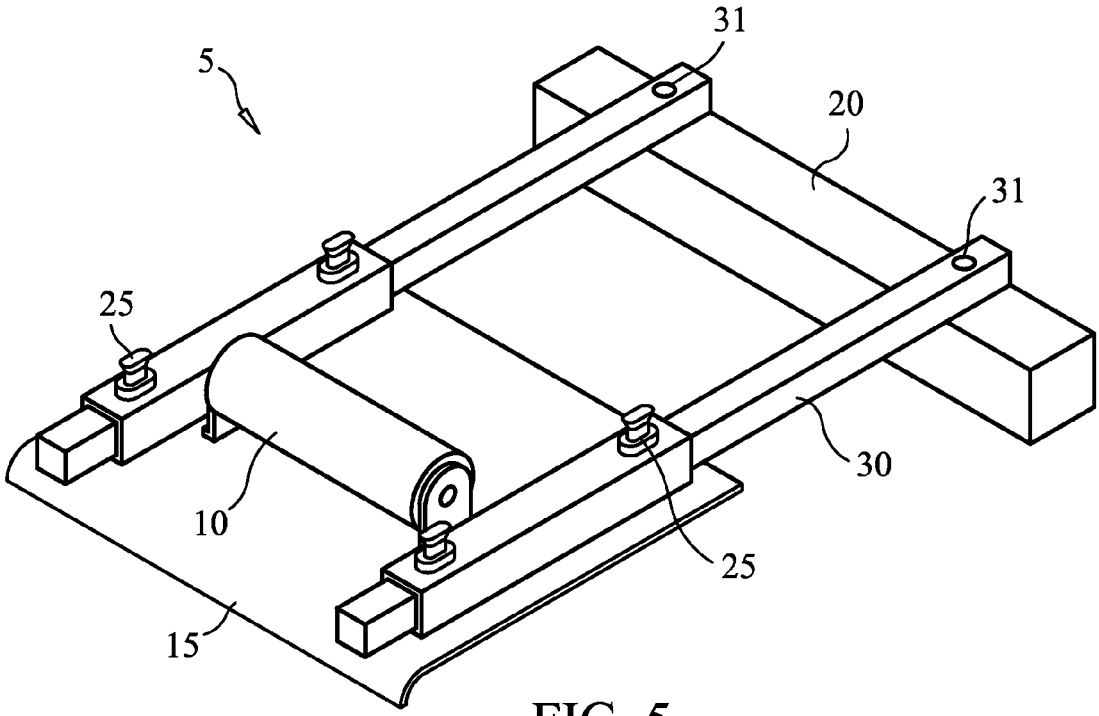
FIG. 5 is an isometric view of the device.

The location of the keyway from the edge of the concrete curb is determined by the thickness of the wall 39. The wall itself must be placed a certain distance from edge of the main concrete curb edge 37 such as depicted in FIG. 3. The keyway maker 20 is positioned such that the keyway maker 20 is placed to form the middle of the keyway. A keyway is essential when the concrete is poured to form a place into which the bottom of the wall form 39 will fit 38 to anchor the wall.

In large construction jobs, reenforced steel 36 such as depicted in FIG. 3 will also be in place to support the wall 39. As the concrete is being poured, a keyway must be formed to anchor the wall. The distance of the keyway maker 20 is positioned by adjusting the length of the horizontal member 30 by moving the members 30 through the tubes 26 and securing them in place by the means to adjust 25. There are many different means to adjust and no one specific means is being claimed although a screw or bolt combination are certainly viable choices.

One end of the flat surface 15 will be slightly curved as depicted in FIG. 1 and this curvature will produce a slight curve on the edge of the concrete slab 37. The curvature of the concrete is mainly produced for cosmetic purposes, but in the prior art it must be done by a separate tool. This tool produces the keyway and the curvature with one tool at the same time during one operation.

The invention claimed is:

1. A combination keyway maker and edger tool, which is comprised of:

a. a flat planar member;

wherein a handle is attached to the flat planar member;

said flat planar member is of a predetermined thickness;

said flat planar member has a top surface and a bottom surface;

wherein a series of tubes are placed on the top surface of the flat planar member;

b. a plurality of horizontal members;

wherein a plurality of horizontal members are attached to the flat planar member;

wherein a means of connection is placed on one end of the plurality of horizontal members;

wherein the plurality of horizontal members are placed within the tubes on the top surface of the flat planar member;

c. keyway maker;

wherein the means of connection secures the keyway maker to one end of the plurality of horizontal members;

said keyway maker extends a predetermined distance downward from the plurality of horizontal members;

d. curved edge;

wherein one edge of the flat planar member is slightly curved downwardly towards the bottom surface.

2. The device as described in claim 1 wherein the keyway maker is tapered.

3. The device as described in claim 1 wherein the means of connection for the plurality of horizontal members is a nut and bolt.

4. The device as described in claim 1 wherein a means to adjust the plurality of horizontal members is a screw.

* * * * *